US005452594A

United States Patent [19]

Kim et al.

[11] Patent Number: 5,452,594

[45] Date of Patent: Sep. 26, 1995

[54] LOW FREQUENCY VIBRATION TYPE WASHING MACHINE AND METHOD

[75] Inventors: Jung C. Kim, Seoul; Dong Y. Oh, Kwangmyung-si; Gyu S. Choe, Euiwang-si; Kyung S. Hong, Inchon-Jikhalsi; Kyung H. Kim, Seoul; Joo H. Lee, Kwacheon-si; Ha I. Lee, Kwangmyung-si; Kyeong B. Park, Seoul; Dong S. Gil, Seoul; Oh H. Kwon, Seoul; Byoung H. Kwon, Busan-Jikhalsi, all of Rep. of Korea

[73] Assignee: Goldstar Co., Ltd., Seoul, Rep. of Korea

[21] Appl. No.: 262,060

[22] Filed: Jun. 17, 1994

[30] Foreign Application Priority Data

Jun. 19, 1993 [KR] Rep. of Korea ..... 1993-11259

[51] Int. Cl.[6] ..... D06F 19/00

[52] U.S. Cl. ..... 68/3 SS; 68/131; 366/116; 366/127

[58] Field of Search ..... 68/3 SS, 133, 68/131; 134/184, 196, 197; 366/113, 116, 108, 127, 267, 268

[56] References Cited

U.S. PATENT DOCUMENTS

| | | | |
|---|---|---|---|
| 1,718,115 | 6/1929 | Covert | 366/267 X |
| 2,172,620 | 9/1934 | Molinare | 68/133 |
| 2,303,940 | 12/1942 | Kuhn | 68/3 SS |
| 2,906,111 | 9/1959 | Long et al. | 68/3 SS |
| 2,919,215 | 12/1959 | Neuhaus et al. | 68/3 SS |
| 2,932,962 | 4/1960 | Stickel | 68/3 SS |
| 2,987,068 | 6/1961 | Branson | 134/184 |
| 3,010,303 | 11/1961 | Bochan | 68/3 SS |
| 3,443,797 | 5/1969 | Branson | 366/116 |
| 3,581,125 | 5/1971 | Arndt et al. | 366/116 |
| 4,168,916 | 9/1979 | Yamada et al. | 366/116 |
| 4,191,611 | 3/1980 | Rushing et al. | 134/184 X |
| 5,276,376 | 1/1994 | Puskas | 366/116 |

*Primary Examiner*—Frankie L. Stinson

*Attorney, Agent, or Firm*—Finnegan, Henderson, Farabow, Garrett & Dunner

[57] ABSTRACT

A low frequency vibration type washing machine is disclosed that is capable of detecting the range of linear reciprocating movement of its drive shaft to control the vibration range of its low frequency oscillating vibrator to be constant, and sensing water level in its washing tub to control the water level. The washing machine includes a low frequency oscillating vibrator adapted to vibrate in a washing tub while being subjected to a water level pressure. The vibrator thereby generates a resonance phenomenon in a multi-phase medium contained in the washing tub. The washing machine also includes a linear motor adapted to drive the low frequency oscillating vibrator, a water level/vibration amplitude sensing unit adapted to detect a vertical vibration amplitude of the vibrator to sense the water level and the vibration amplitude in the washing tub, a commanding unit adapted to output a signal corresponding to a vibration amplitude selected by a user, and a control unit adapted to recognize the water level from an output signal of the sensing unit, compare the output signal of the sensing unit with an output signal of the commanding unit, and control the linear motor so that the vibrator vibrates at a vibration amplitude approximating the output signal of the commanding unit.

5 Claims, 5 Drawing Sheets

FIG.4a
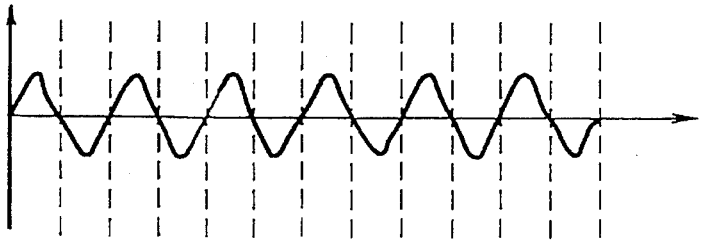
FIG.4b
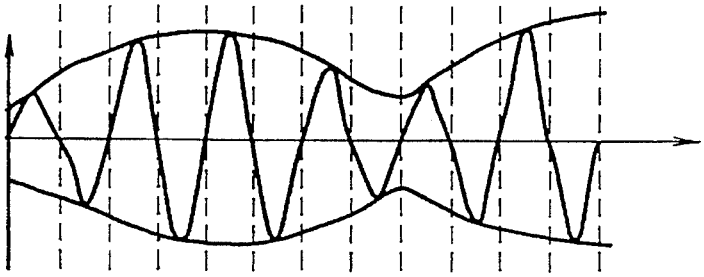
FIG.5a
FIG.5c
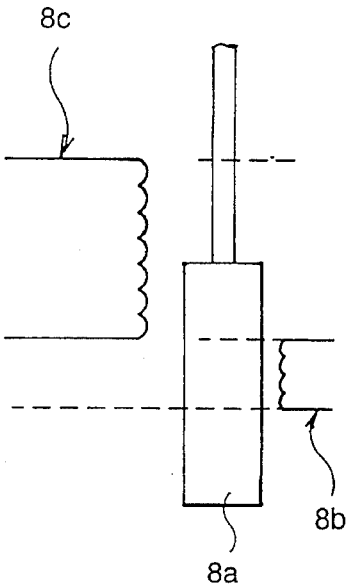
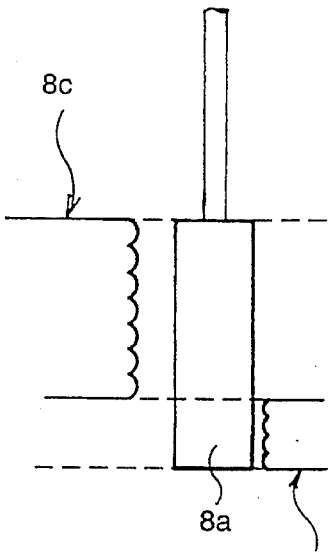
FIG.5b
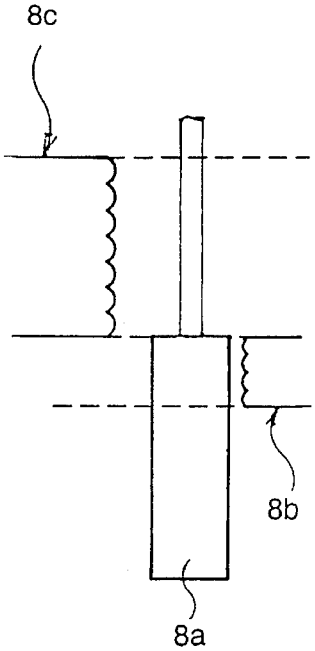

LOW FREQUENCY VIBRATION TYPE WASHING MACHINE AND METHOD

BACKGROUND OF THE INVENTION

The present invention relates to an apparatus for and a method of achieving a low frequency vibration type washing by utilizing a resonance phenomenon of a multi-phase medium made of water, detergent and air caused by a particular frequency.

Generally, existing washing machines employ a pulsator washing system including a pulsator installed on the bottom of a washing tub and adapted to wash clothes by rotating in normal and reverse directions. However, such washing machines have a problem of clothes getting tangled because the pulsator rotates alternatingly in normal and reverse directions. For solving such a problem encountered in the pulsator washing system, various positive research efforts have been made recently. One of the washing machines that resulted from these research efforts is a low frequency vibration type washing machine.

FIG. 1 is a schematic view illustrating a conventional low frequency vibration type washing machine. As shown in FIG. 1, the washing machine includes a washing tub 1 containing water, detergent and clothes to be washed therein, a low frequency oscillating vibrator 2 disposed on the bottom of washing tub 1 and adapted to generate a resonance phenomenon at a multi-phase medium made of a washing liquid (water and detergent) and an air layer, and a linear motor 3 adapted to drive the low frequency oscillating vibrator 2. A drive shaft 4 extends vertically through the bottom of washing tub 1. The drive shaft 4 connects the low frequency oscillating vibrator 2 to the linear motor 3 so as to transmit a reciprocating movement of the linear motor 3 to the low frequency oscillating vibrator 2. The washing machine further includes a low frequency generator 5, adapted to generate a waveform having a frequency band ranged from 20 Hz to 250 Hz, an amplitude ranging from 2 mm to 25 mm and a rotation angle amplitude ranging from 2° to 10°, and thereby drive the linear motor 3, an amplifier 6 adapted to amplify an output signal of the low frequency generator 5 and apply the amplified signal to the linear motor 3, and a pressure sensor 15 adapted to detect the pressure of water supplied in the washing tub 1 and measure the level of the supplied water in the washing tub 1.

Operation of the conventional low frequency vibration type washing machine having the above-mentioned construction will now be described.

First, as the low frequency generator 5 generates a waveform having a frequency band of 20 to 250 Hz, an amplitude of 2 to 25 mm and a rotation angle amplitude of 2° to 10°, the amplifier 6 amplifies the generated waveform and then sends it to the linear motor 3.

Upon receiving the waveform generated from the low frequency generator 5, the linear motor 3 is actuated, so that the low frequency oscillating vibrator 2 connected to the drive shaft 4 of the linear motor 3 can oscillate. As the low frequency oscillating vibrator 2 oscillates, a resonance phenomenon occurs at the multi-phase medium made of the water, detergent and air layer contained in the washing tub 1. The resonance phenomenon generates small air bubbles in the multi-phase medium while generating cavitation phenomena or non-linear vibrations thereof. As a result, the mechanical energy obtained by these cavitation phenomena or non-linear vibrations of small air bubbles is combined with the chemical action of the detergent in the multi-phase medium, thereby enabling a washing or cleaning to be effectively carried out.

The linear motor 3 serves to linearly reciprocate the drive shaft 4 in the vertical direction so that the low frequency oscillating vibrator 2 can vibrate at the same frequency as the resonance frequency of the multi-phase medium. The range of the linear reciprocating movement of the drive shaft 4 is determined by the amplitude of the drive waveform applied to the linear motor 3.

As water is supplied in the washing tub 1, the water level in the washing tub 1 is increased. For controlling the water level in the washing tub 1, the pressure sensor 7 detects the pressure of water contained in the washing tub 1 and converts the detected water pressure into an electrical signal which is, in turn, transmitted to a control unit not shown.

However, the conventional low frequency vibration type washing machine has the following problems.

Although the low frequency generator 5 generates and outputs a constant low frequency, the vibration amplitude of the low frequency oscillating vibrator 2 may be non-uniform due to factors involved in the system itself or external factors. For this reason, the washing and cleaning efficiency may be lowered.

Furthermore, the conventional washing machine is not equipped with any system for detecting the vibration amplitude and controlling the output frequency of the low frequency generator 5. As a result, it is impossible to control an accurate vibration amplitude based on water level and predetermined control value.

SUMMARY OF THE INVENTION

Therefore, an object of the invention is to solve the above-mentioned problems encountered in the prior art and, thus, to provide a low frequency vibration type washing machine capable of detecting the range of linear reciprocating movement of its drive shaft to control the vibration range of its low frequency oscillating vibrator to be constant, and sensing the water level in its washing tub to control the water level, while employing a simple construction, and a method for achieving the improved low frequency vibration type washing.

In accordance with one aspect, the present invention provides a low frequency vibration type washing machine comprising: a low frequency oscillating vibrator adapted to vertically vibrate in a washing tub equipped in the washing machine while being subjected to a pressure caused by a water level in the washing tub and thereby generate a resonance phenomenon at a multi-phase medium contained in the washing tub; a linear motor adapted to drive the low frequency oscillating vibrator; a drive shaft adapted to transmit a drive force of the linear motor to the low frequency oscillating vibrator; water level/vibration amplitude sensing means adapted to detect a vertical vibration amplitude of the low frequency oscillating vibrator to sense the water level and the vibration amplitude; a commanding unit adapted to output a signal corresponding to a vibration amplitude selected by a user; and control means adapted to recognize the water level from an output signal of the water level/vibration amplitude sensing means, compare the output signal of the water level/vibration amplitude sensing means with an output signal of the commanding unit, and control the linear motor so that the low frequency oscillating vibrator vibrates at a vibration amplitude approximating to the output signal of the commanding unit.

In accordance with another aspect, the present invention provides a low frequency vibration type washing method comprising the steps of: detecting a water level and a vibration amplitude in a washing tub, the vibration amplitude resulting from a vibration of a vibrator; comparing a value indicative of the detected vibration amplitude and a command value indicative of a vibration amplitude selected by a user; and controlling a vibration frequency of the vibrator so that a difference between the compared values can be minimized.

BRIEF DESCRIPTION OF THE DRAWINGS

Other objects and aspects of the invention will become apparent from the following description of embodiments with reference to the accompanying drawings in which:

FIGS. 4*a* and 4*b* are waveform diagrams respectively illustrating output signals of a radio frequency generator and a stroke sensor in accordance with the present invention;

FIGS. 5*a* to 5*c* are schematic views respectively illustrating different positions of a core of the stroke sensor;

DETAILED DESCRIPTION OF THE PREFERRED EMBODIMENTS

Figure 1:
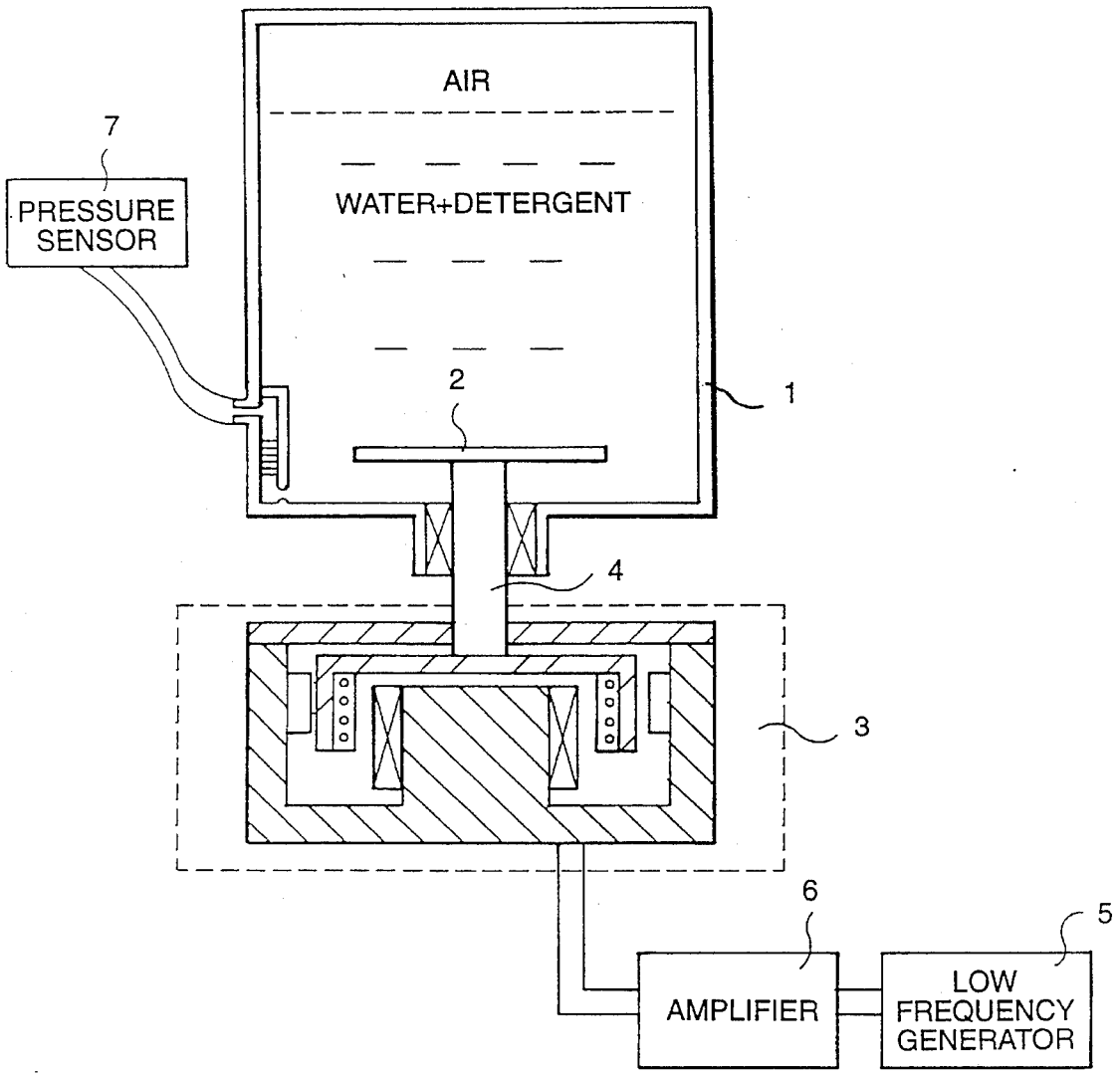
FIG. 1 is a schematic view illustrating a conventional low frequency vibration type washing machine.
Figure 2:
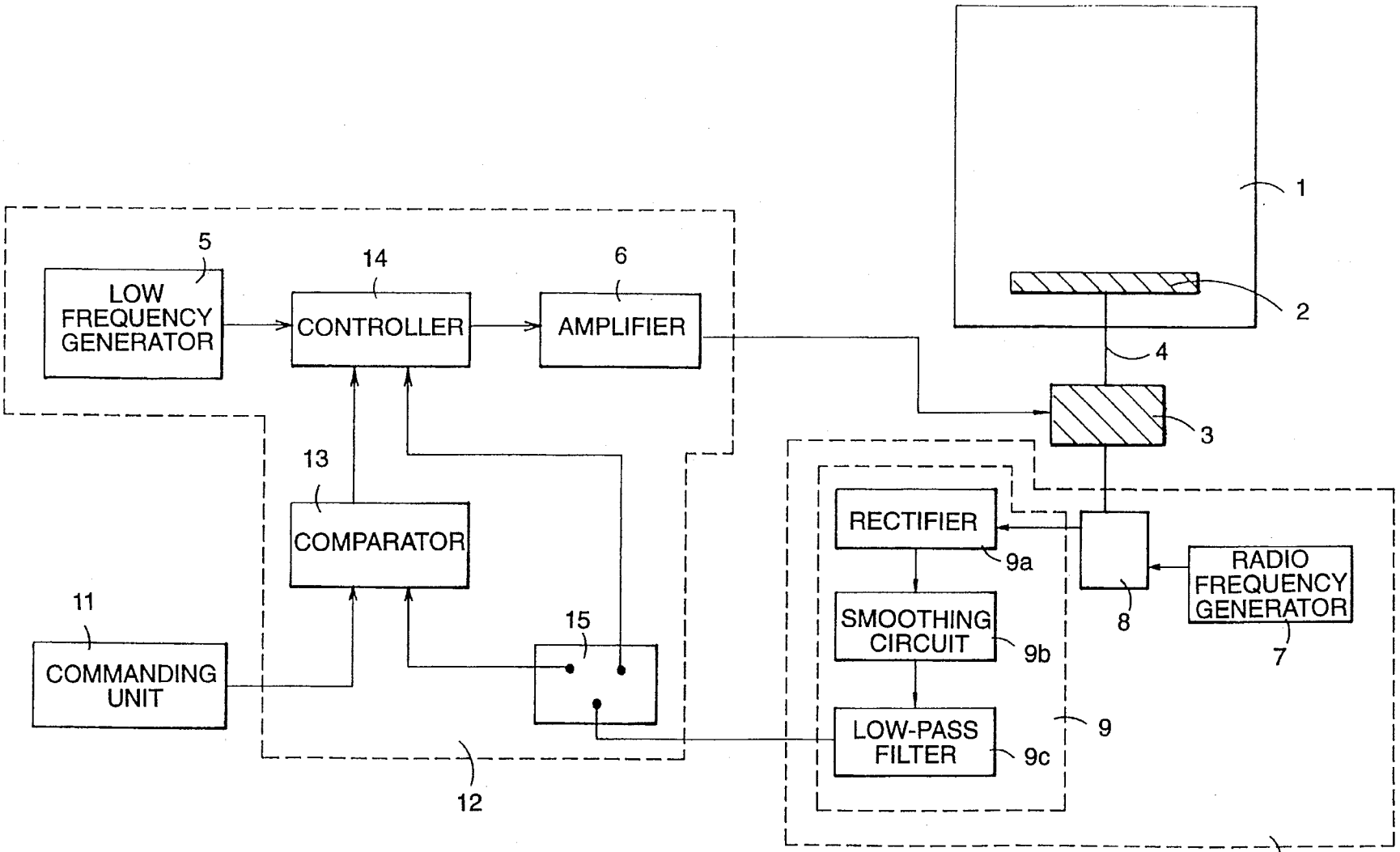
FIG. 2 is a block diagram of a low frequency vibration type washing machine in accordance with the present invention.

FIG. 2 is a block diagram of a low frequency vibration type washing machine in accordance with the present invention. In FIG. 2, elements corresponding to those in FIG. 1 are denoted by the same reference numerals.

As shown in FIG. 2, the washing machine includes a washing tub 1 containing water, detergent and clothes to be washed therein, a low frequency oscillating vibrator 2 disposed on the bottom of washing tub 1 and adapted to generate a resonance phenomenon at a multi-phase medium made of a washing liquid (water and detergent) and an air layer, and a linear motor 3 adapted to drive the low frequency oscillating vibrator 2. A drive shaft 4 extends vertically through the bottom of washing tub 1. The drive shaft 4 connects the low frequency oscillating vibrator 2 to the linear motor 3 so as to transmit a reciprocating movement of the linear motor 3 to the low frequency oscillating vibrator 2. The washing machine further includes a water level/vibration amplitude sensing unit 10 adapted to detect a vertical vibration amplitude of the low frequency oscillating vibrator 2 to sense the water level and vibration amplitude in the washing tub 1, a commanding unit adapted to output a signal corresponding to a vibration amplitude selected by a user, and a control unit 12 adapted to recognize the water level from an output signal of the water level/vibration amplitude sensing unit 10, compare the output signal of the water level/vibration amplitude sensing unit 10 with an output signal of the commanding unit 11, and control the linear motor 3 so that the low frequency oscillating vibrator 2 vibrates at a vibration amplitude approximating to the output signal of the commanding unit 11.

The water level/vibration amplitude sensing unit 10 includes a radio frequency generator 7 adapted to generate a constant radio frequency signal, a stroke sensor 8 disposed at the terminal end of the drive shaft 4 of the linear motor 3 and adapted to receive the radio frequency signal from the radio frequency generator 7 and generate a voltage variable depending on the water pressure in the washing tub 1 and the displacement of the drive shaft 4 resulted from the actuation of the linear motor 3, and a variation in linear reciprocating movement of the drive shaft 4, based on the received radio frequency signal, and a waveform shaping circuit 9 adapted to rectify, smooth and then filter the voltage outputted from the stroke sensor 8 and thereby convert the voltage into a DC voltage to be outputted. On the other hand, the control unit 12 includes a low frequency generator 5 adapted to generate a waveform having a frequency band ranged from 20 Hz to 250 Hz, an amplitude ranged from 2 mm to 25 mm and a rotation angle amplitude ranged from 2° to 10° and thereby drive the linear motor 3, a comparator 13 adapted to compare the output signal of the water level/vibration amplitude sensing unit 10 with the output signal of the commanding unit 11, and a switch 15 adapted to selectively apply the output signal of the water level/vibration amplitude sensing unit 10 to the comparator 13 and a controller 14. This controller 14 serves to recognize the water level in the washing tub 1 from the output signal of the water level/vibration amplitude sensing unit 10 received via the switch 15. The controller 14 also receives an output signal from the comparator 13 and thereby recognizes the difference between the command signal of the commanding unit 11 and the current washing vibration amplitude. Based on the result of the recognitions, the controller 14 controls the low frequency generator 5 such that the signal generated from the low frequency generator 5 approximates to the command signal. The control unit 12 further includes an amplifier 6 adapted to amplify an output signal of the controller 14 in a pulse width modulation (PWM) manner.

Figure 3:
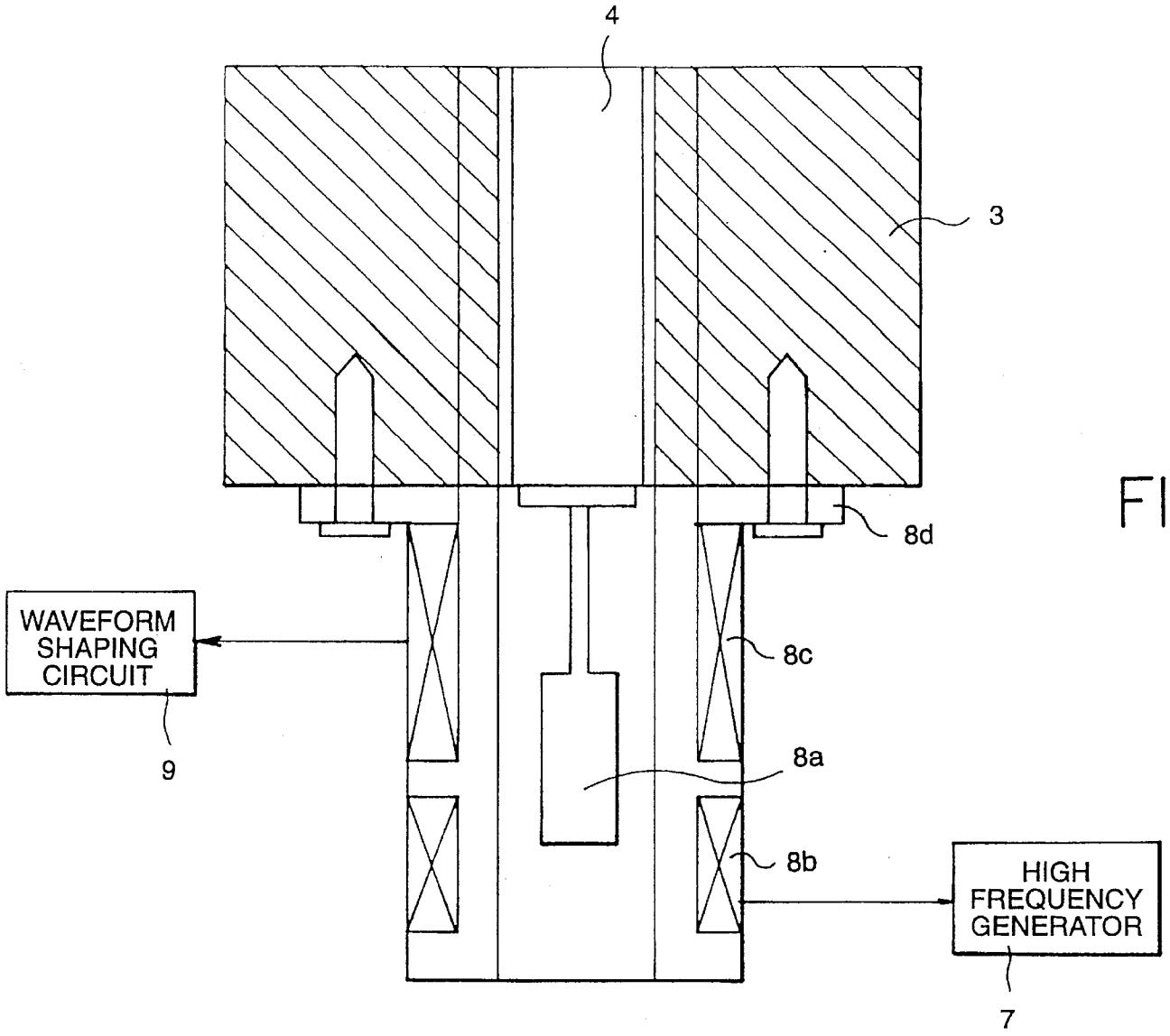
FIG. 3 is a sectional view of the stroke sensor 8 in accordance with the present invention.

FIG. 3 is a sectional view of the stroke sensor 8 in accordance with the present invention.

As shown in FIG. 3, the stroke sensor 8 includes a core 8*a* disposed beneath the drive shaft 4 and operatively connected to the drive shaft 4 to vertically vibrate by the vertical reciprocating movement of the drive shaft 4, a primary coil 8*b* disposed around the lower end of the core 8*a* and adapted to induce a voltage from the high frequency signal generated from the high frequency generator 7, a secondary coil 8c disposed above the primary coil 8*b* and adapted to generate a voltage variably induced depending on the vibration amplitude of the core 8*a* when the voltage induction occurs at the primary coil 8*b* and output the induced voltage to the waveform shaping circuit 9, and a bobbin 8d adapted to support both the primary and secondary coils 8*b* and 8*c*.

As shown in FIG. 2, the waveform shaping circuit 9 includes a rectifier 9*a* for rectifying the variable voltage induced at the secondary coil 8*c*, a smoothing circuit 9*b* for smoothing an output from the rectifier 9*a* and a low-pass filter 9*c* for converting an output from the smoothing circuit 9*b* into a predetermined DC signal to be outputted.

Operation of the low frequency vibration type washing machine in accordance with the present invention will now be described.

For facilitating the understanding of the operation of the washing machine, the operation for sensing the water level and vibration amplitude will be described prior to the description of the overall operation of the washing machine.

Figure 6A:
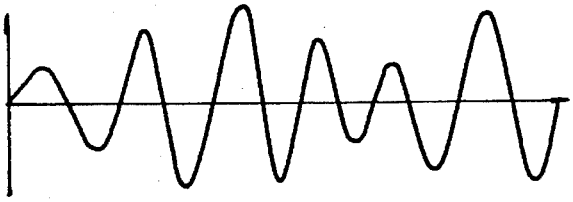
FIGS. 6*a* to 6*c* are waveform diagrams respectively illustrating different output signals of a waveform shaping circuit in accordance with the present invention.
Figure 6B:
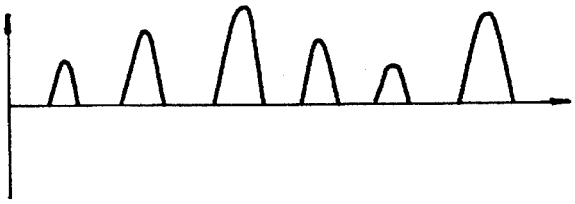
Figure 6C:
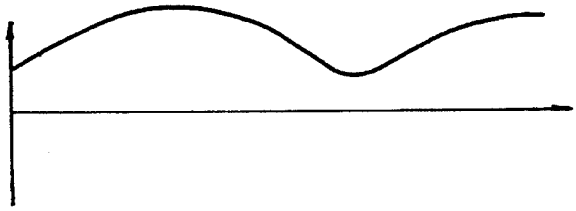
Figure 7A:
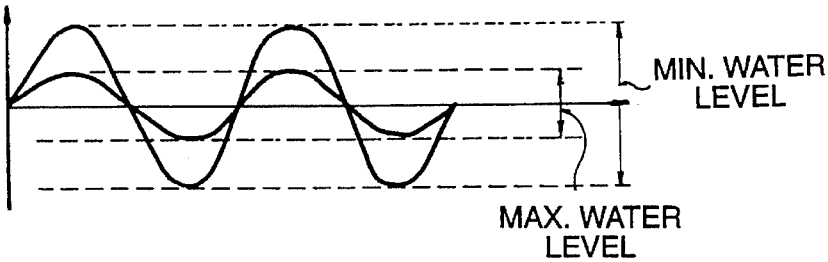
FIGS. 7*a* and 7*b* are waveform diagrams respectively illustrating water level detect signals outputted from elements of the water level and vibration amplitude sensing unit.
Figure 7B:
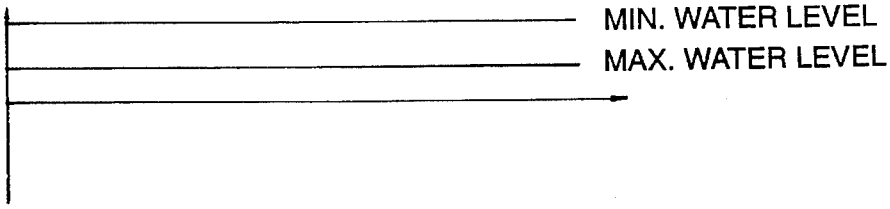

FIGS. 4*a* and 4*b* are waveform diagrams respectively illustrating output signals of the radio frequency generator and the stroke sensor. FIGS. 5*a* to 5*c* are schematic views respectively illustrating different positions of the core of stroke sensor. FIGS. 6*a* to 6*c* are waveform diagrams respectively illustrating different output signals of the waveform shaping circuit. FIGS. 7*a* and 7*b* are waveform diagrams respectively illustrating water level detect signals outputted from elements of the water level and vibration amplitude sensing unit.

First, the operation for sensing the vibration amplitude will be described.

As the linear motor 3 is actuated, the low frequency oscillating vibrator 2 connected to the drive shaft 4 of the linear motor 3 vibrates. As the low frequency oscillating vibrator 2 vibrates, a resonance phenomenon occurs at the multi-phase medium made of the water, detergent and air layer contained in the washing tub 1.

Simultaneously, the core 8*a* of stroke sensor 8, operatively connected to the drive shaft 4, reciprocates vertically. As a result, a voltage shown in FIG. 4*a* is induced at the first primary coil 8*b* of stroke sensor 8 by a radio frequency signal outputted from the radio frequency generator 7. At the secondary coil 8*c* of stroke sensor 8, a voltage shown in FIG. 4*b* is induced which is variable depending on the vibration amplitude of the core 8*a*. The variable voltage is applied to the waveform shaping circuit 9.

The voltage induced at the secondary coil 8*c* is varied depending on the position of the core 8*a*. This variation in voltage can be expressed by the following equation:

$$V = L\frac{di}{dt}$$

where, V represents an induced voltage and L represents a reactance.

When the core 8*a* is positioned at its uppermost position, as shown in FIG. 5*a*, the reactance L has the maximum value Lmax. At the lowermost position of the core 8*a*, as shown in FIG. 5*b*, the reactance L has the minimum value Lmin. When the core 8*a* is positioned at an intermediate position, as shown in FIG. 5*c*, the reactance L has a value corresponding to half the maximum reactance Lmax (L=½ Lmax).

Figure 6D:
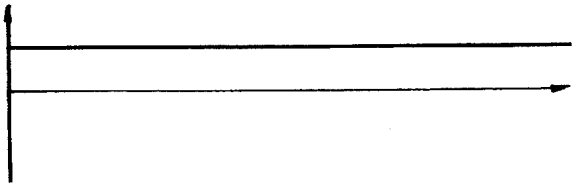
FIG. 6*d* is a diagram showing conversion of the waveform of FIG. 6*c* to a DC voltage.

The variable voltage (FIG. 6*a*) from the secondary coil applied to the rectifier 9*a* of the waveform shaping circuit 9 is half-wave or full-wave rectified by the rectifier 9*a*, as shown in FIG. 6*b*, smoothed by the smoothing circuit 9*b*, as shown in FIG. 6*c*, and then converted into a DC voltage by the low-pass filter 9*c*, as shown in FIG. 6*d*. The DC voltage from the low-pass filter 9*c* is applied to the switch 15.

Accordingly, the DC voltage outputted from the low-pass filter 9*c* has a value proportional to the measured stroke value, namely, the reciprocating movement range of the core 8*a*.

Now, operation for sensing the water level will be described.

Generally, supplying of water in the washing tub 1 is carried out prior to the washing operation of the washing machine. As water is supplied in the washing tub 1, the water pressure in the washing tub 1 is increased. Such an increase in water pressure affects the drive shaft 4 of linear motor 3.

In other words, as the water pressure increases, the drive shaft 4 is moved downwards in proportion to the increased water pressure. This downward movement of drive shaft 4 results in a downward movement of the core 8*a* of stroke sensor 8, thereby causing the reactance to be decreased. As a result, the voltage induced at the secondary coil 8*c* of stroke sensor 8 is gradually decreased in reverse proportion to the water level, as shown in FIG. 7*a*. Accordingly, the DC voltage outputted from the low-pass filter 9*c* of waveform shaping circuit 9 has a level reversely proportional to the water level in the washing tub 1. Upon receiving the DC voltage, the control unit 12 can control the water level in the washing tub 1.

The overall operation of the low frequency vibration type washing machine is controlled on the basis of the sensed water level and vibration amplitude. This operation will now be described.

When the supplying of water in the washing tub 1 is initiated, the controller 14 of control unit 12 controls the switch 15 so that an output signal from the water level/vibration amplitude sensing unit 10 can be directly applied to the controller 14. Upon receiving the output signal from the water level/vibration amplitude sensing unit 10, the controller 14 determines the voltage level of the received signal and thereby recognizes the water level.

After the recognition of water level, the controller 14 controls the switch 15 again so that the output signal from the water level/vibration amplitude sensing unit 10 can be applied to the comparator 13. Upon receiving the output DC voltage from the low-pass filter 9*c* of waveform shaping circuit 9, the comparator 13 compares the received DC voltage with a command value from the commanding unit 11. The command value is indicative of a desired vibration amplitude of the low frequency oscillating vibrator 2. After the comparison, the comparator 13 sends the difference between the DC voltage and the command value to the controller 14.

At the beginning of the operation, the output signal of the water level/vibration amplitude sensing unit 10 corresponds only to the water level because the control unit 12 does not activate the linear motor 3 yet. At this state, therefore, no vibration amplitude is involved. As a result, the voltage level difference between the output signal of the water level/vibration amplitude sensing unit 10 and the output signal of the commanding unit 11 is high. In this case, accordingly, the controller 14 controls the low frequency generator 5 by adjusting a voltage level of the output signal of the commanding unit 11 so as to control the linear motor 3.

For controlling the linear motor 3, the output signal of the water level/vibration amplitude sensing unit 10 is compared with the output signal of the commanding unit 11 in the comparator 13. When the voltage level difference outputted from the comparator 13 is high, the controller 14 recognizes the vibration amplitude of the low frequency oscillating vibrator 2 to be low and controls the commanding unit 11 to generate a higher vibration amplitude command value. On the other hand, when the voltage level difference outputted from the comparator 13 is low, the controller 14 recognizes the vibration amplitude of the low frequency oscillating vibrator 2 to be high and controls the commanding unit 11 to generate a lower vibration amplitude command value.

By repeating the above procedures, the controller 14 controls the vibration amplitude of the low frequency oscillating vibrator 2 to approximate to the command signal of the commanding unit 11, thereby enabling the vibration amplitude to be constant.

As apparent from the above description, the present invention provides the following effects.

First, it is possible to accurately sense the water level and the vibration width with a simple construction because the sensing of the water level and vibration width can be achieved by the stroke sensor disposed at the terminal end of the drive shaft of the linear motor for driving the low frequency oscillating vibrator.

Second, optimum washing and cleaning effects can be obtained because the water level/vibration amplitude sensing unit senses the water level in the washing tub and the vibration amplitude of the low frequency oscillating vibrator so that the low frequency vibration can be controlled such that its vibration amplitude approximates the command value.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A low frequency vibration type washing machine comprising:

a low frequency oscillating vibrator adapted to vertically vibrate in a washing tub equipped in the washing machine while being subjected to a pressure caused by a water level in the washing tub and thereby generate a resonance phenomenon in a multi-phase medium contained in the washing tub;

a linear motor adapted to drive the low frequency oscillating vibrator;

a drive shaft adapted to transmit a drive force of the linear motor to the low frequency oscillating vibrator;

water level/vibration amplitude sensing means adapted to detect a vertical vibration amplitude of the low frequency oscillating vibrator to sense the water level and the vibration amplitude;

a commanding unit adapted to output a signal corresponding to a vibration amplitude selected by a user; and control means adapted to recognize the water level from an output signal of the water level/vibration amplitude sensing means, compare the output signal of the water level/vibration amplitude sensing means with an output signal of the commanding unit, and control the linear motor so that the low frequency oscillating vibrator vibrates at a vibration amplitude approximating the output signal of the commanding unit.

2. A low frequency vibration type washing machine in accordance with claim 1, wherein the control means comprises:

a low frequency generator adapted to generate a waveform having a predetermined frequency band, a predetermined amplitude, and a predetermined rotation angle amplitude in the washing tub;

a comparator adapted to compare the output signal of the water level/vibration amplitude sensing means with the output signal of the commanding unit;

a controller adapted to recognize the water level in the washing tub from the output signal of the water level/vibration amplitude sensing means, recognizes the difference between the command signal of the commanding unit 11 and the current washing vibration amplitude, based on an output signal from the comparator, and control an output signal from the low frequency generator such that the output signal from the low frequency generator approximates to the command signal;

a switch adapted to selectively apply the output signal of the water level/vibration amplitude sensing means to the controller under a control of the controller; and an amplifier adapted to amplify an output signal of the controller in a pulse width modulation manner.

3. A low frequency vibration type washing machine in accordance with claim 1, wherein the water level/vibration amplitude sensing means comprises:

a radio frequency generator adapted to generate a constant radio frequency signal;

a stroke sensor disposed at a terminal end of the drive shaft of the linear motor and adapted to receive the radio frequency signal from the radio frequency generator and generate a voltage variable depending on the water level pressure in the washing tub and the displacement of the drive shaft resulting from an actuation of the linear motor, and a variation in linear reciprocating movement of the drive shaft, by the received radio frequency signal; and a waveform shaping circuit adapted to rectify, smooth and then filter the voltage outputted from the stroke sensor and thereby convert the voltage into a DC voltage to be outputted.

4. A low frequency vibration type washing machine in accordance with claim 3, wherein the stroke sensor comprises:

a core operatively connected to the drive shaft to be displaced;

a primary coil adapted to induce a voltage from the high frequency signal generated from the high frequency generator;

a secondary coil adapted to generate a voltage variably induced depending on a displacement of the core when the voltage induction occurs at the primary coil; and a bobbin adapted to support both the primary and secondary coils.

5. A low frequency vibration type washing machine in accordance with claim 3, wherein the waveform shaping circuit comprises:

a rectifier for rectifying the output voltage from the stroke sensor;

a smoothing circuit for smoothing an output signal from the rectifier; and a low-pass filter for converting an output signal from the smoothing circuit into a predetermined DC signal to be outputted.

* * * * *

UNITED STATES PATENT AND TRADEMARK OFFICE

CERTIFICATE OF CORRECTION

PATENT NO. : 5,452,594

DATED : September 26, 1995

INVENTOR(S) : Jung Chul KIM et al

It is certified that error appears in the above-indentified patent and that said Letters Patent is hereby corrected as shown below:

Claim 2, Column 8, Line 8, Delete "to".

Signed and Sealed this

Third Day of September, 1996

*Attest:*

*Attesting Officer*

BRUCE LEHMAN

*Commissioner of Patents and Trademarks*